US010850892B2

(12) United States Patent
Kodama et al.

(10) Patent No.: US 10,850,892 B2
(45) Date of Patent: Dec. 1, 2020

(54) SHEET MATERIAL CONTAINER

(71) Applicant: Kao Corporation, Tokyo (JP)

(72) Inventors: Daisuke Kodama, Sumida-ku (JP); Yoshinori Inagawa, Sumida-ku (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 16/646,027

(22) PCT Filed: Jul. 12, 2018

(86) PCT No.: PCT/JP2018/026346
§ 371 (c)(1),
(2) Date: Mar. 10, 2020

(87) PCT Pub. No.: WO2020/012607
PCT Pub. Date: Jan. 16, 2020

(65) Prior Publication Data

US 2020/0207518 A1 Jul. 2, 2020

(51) Int. Cl.

| | |
|---|---|
| ***B65D 33/00*** | (2006.01) |
| ***B65D 75/52*** | (2006.01) |
| *B65D 33/02* | (2006.01) |
| *B65D 33/16* | (2006.01) |

(52) U.S. Cl.
CPC ..... *B65D 33/004* (2013.01); *B65D 75/52* (2013.01); *B65D 33/007* (2013.01); *B65D 33/02* (2013.01); *B65D 33/16* (2013.01); *B65D 2203/00* (2013.01)

(58) Field of Classification Search
USPC ..... 206/457, 459.5
See application file for complete search history.

(56) References Cited

U.S. PATENT DOCUMENTS

2006/0027478 A1 2/2006 Kaufman et al.
2011/0155686 A1* 6/2011 Maki ..... B65D 1/0215 215/40
2013/0292287 A1 11/2013 Stanley et al.
(Continued)

FOREIGN PATENT DOCUMENTS

CN 107635883 A 1/2018
CN 107848684 A 3/2018
(Continued)

OTHER PUBLICATIONS

International Search Report dated Oct. 9, 2018 in PCT/JP2018/026346 filed Jul. 12, 2018, citing documents AD, AF, BN, and AX therein, 1 page.

(Continued)

*Primary Examiner* — Jacob K Ackun
(74) *Attorney, Agent, or Firm* — Oblon, McClelland, Maier & Neustadt, L.L.P.

(57) ABSTRACT

A sheet material container (C1) comprising a containing portion (10*a*) that contains contents (96) and formed of a layer sheet (120S). Among a first inner layer sheet (122Sa, 123Sa), a first outer layer sheet (121Sa) and a second inner layer sheet (122Sb, 123Sb), a sheet on one side of the sheet material container C1 with respect to a decorative portion (36*b*, 36*c*, 36*d*, 36*h*) has a light transmitting portion (34*d*, 34*e*, 34*f*, 34*g*) capable of transmitting visible light. The plurality of decorative portions (36*b*, 36*c*, 36*d*, 36*h*) are configured to be at positions where visible light is transmitted from the outside of the sheet material container (C1).

19 Claims, 8 Drawing Sheets

(56) References Cited

U.S. PATENT DOCUMENTS

| | | | | |
|---|---|---|---|---|
| 2013/0292353 | A1* | 11/2013 | Stanley | B32B 27/327 215/12.1 |
| 2014/0033654 | A1 | 2/2014 | Stanley et al. | |
| 2015/0360816 | A1* | 12/2015 | Chen | B29C 65/14 206/457 |
| 2016/0083137 | A1* | 3/2016 | Serras | B65B 21/245 206/457 |
| 2017/0144800 | A1* | 5/2017 | Lucchese | B65D 75/566 |
| 2019/0168941 | A1 | 6/2019 | Otsuka et al. | |
| 2019/0185213 | A1 | 6/2019 | Kodama et al. | |
| 2019/0248546 | A1 | 8/2019 | Inagawa et al. | |

FOREIGN PATENT DOCUMENTS

| | | | |
|---|---|---|---|
| EP | 3 483 085 | A1 | 5/2019 |
| EP | 3 593 984 | A1 | 1/2020 |
| JP | 2015-520706 | A | 7/2015 |
| JP | 2015-524778 | A | 8/2015 |
| JP | 2015-527269 | A | 9/2015 |
| JP | 6 186 547 | B1 | 8/2017 |
| JP | 2017-141063 | A | 8/2017 |
| JP | 6186546 | B1 | 8/2017 |
| JP | 2018-108842 | A | 7/2018 |
| JP | 2018-108843 | A | 7/2018 |
| JP | 2018-144363 | A | 9/2018 |
| JP | 2018-144856 | A | 9/2018 |
| JP | 2018-144857 | A | 9/2018 |
| JP | 2018-144860 | A | 9/2018 |
| JP | 2018-144885 | A | 9/2018 |
| JP | 2018-144886 | A | 9/2018 |
| JP | 2018-144888 | A | 9/2018 |
| JP | 6510151 | B1 | 5/2019 |
| JP | 2019-214398 | A | 12/2019 |
| JP | 2019-218072 | A | 12/2019 |
| TW | M544479 | U | 7/2017 |
| WO | WO 2014/025609 | A1 | 2/2014 |
| WO | WO 2018/164117 | A1 | 9/2018 |

OTHER PUBLICATIONS

Taiwanese Office Action dated Dec. 25, 2019 in Taiwanese Patent Application No. 108123582, citing documents BO and BP therein, 8 pages.

Written Opinion dated Oct. 9, 2018, in PCT/JP2018/026346 (with English Translation).

Chinese Office Action dated Jul. 15, 2020, in Chinese Patent Application No. 201880056845.9 (with English Translation).

Extended European Search Report dated Oct. 5, 2020, in European Patent Application No. 18926043.3.

* cited by examiner

SHEET MATERIAL CONTAINER

TECHNICAL FIELD

The present invention relates to a sheet material container and a sheet material container filled with contents.

BACKGROUND ART

In recent years, sheet material containers formed of sheet materials have been proposed in which an non-attached region is partially provided between layers of the sheet materials and encloses a filler such as air to form a filled portion to the non-attached region in order to improve shape retention or the like (for example, Patent Document 1).

CITATION LIST

Patent Document 1: International Publication No. WO 2014/025609

SUMMARY OF THE INVENTION

The present invention relates to a sheet material container comprising a containing portion that contains contents and formed of a layer sheet, wherein the layer sheet includes a first layer sheet on one side of the sheet material container, and a second layer sheet on the other side of the sheet material container with the containing portion interposed therebetween, the first layer sheet includes a first inner layer sheet and a first outer layer sheet covering the outer side of the first inner layer sheet, the second layer sheet includes a second inner layer sheet and a second outer layer sheet covering the outer side of the second inner layer sheet, at least one of the first inner layer sheet and the first outer layer sheet, or the second inner layer sheet and the second outer layer sheet has a attached portion partially attached to each other and a non-attached region not attached to each other, a filled portion enclosing a filler is formed between the first inner layer sheet and the first outer layer sheet in the non-attached region or between the second inner layer sheet and the second outer layer sheet in the non-attached region, any two or more of the first inner layer sheet, the first outer layer sheet, the second inner layer sheet and the second outer layer sheet are decorative sheets provided with a decorative portion, the plurality of decorative sheets have overlapping portions that overlap with each other while being separated from each other across the containing portion or the filled portion, and the decorative portion is provided in the overlapping portions, among the first inner layer sheet, the first outer layer sheet, and the second inner layer sheet, a sheet on the one side of the sheet material container with respect to the decorative portion has a light transmitting portion capable of transmitting visible light, the decorative portion is located at a position where visible light is transmitted from the outside of the sheet material container by the light transmitting portion.

DESCRIPTION OF EMBODIMENTS

Figure 1:
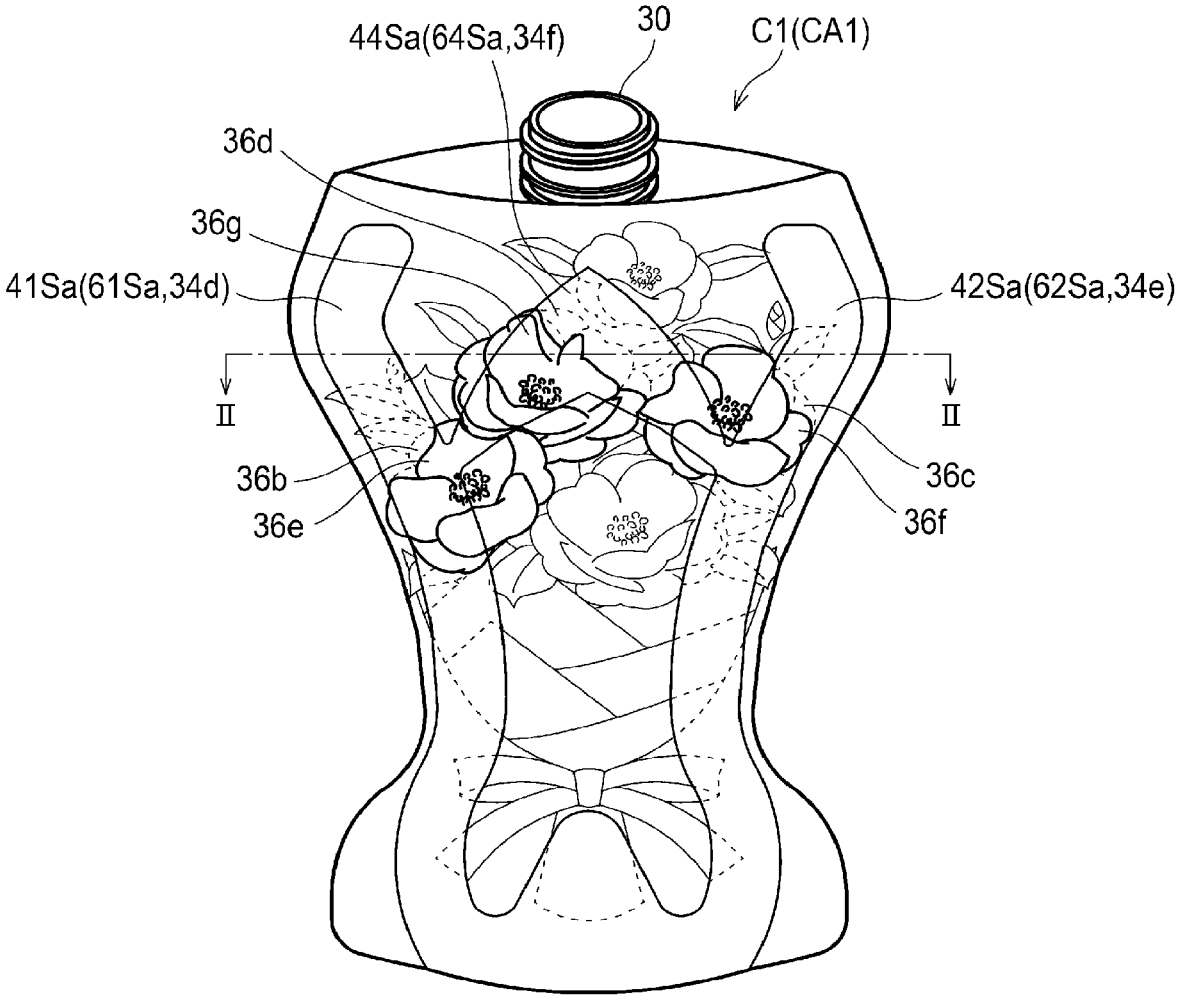
FIG. 1 is a top perspective view of a sheet material container (sheet material container filled with contents) according to the first embodiment.

In the sheet material container disclosed in Patent Document 1, the inner sheet and the outer sheet constituting the sheet material container are decorated by printing or the like. However, depending on the technique disclosed in Patent Document 1, it has been difficult to three-dimensionally represent the decorative portion of the inner sheet with depth, particularly with respect to the outer shape of the container, on the center side of the container.

According to the present invention, a plurality of decorative sheets have overlapping portions that overlap with each other while being separated from each other with the containing portion or the filled portion interposed therebetween, and the decorative portion is provided in the overlapping portion, and the sheet on one side of the sheet material container with respect to the decorative portion has a light transmitting portion capable of transmitting visible light. According to the present invention, it is possible to impart a three-dimensional effect to the sheet material container which cannot be expressed by normal film decoration of the sheet material container.

Now, preferred embodiments of the present invention will be described with reference to the drawings.

The embodiments described below are merely examples for easy understanding of the present invention and do not limit the present invention. Specifically, shapes, dimensions, arrangements, or the like of members described below may be changed or improved without departing from the gist of the present invention, and the present invention includes equivalents thereof.

In all the drawings, like components are denoted by like reference numerals and overlapping descriptions will not be repeated as appropriate.

<<Outline>>

First, with reference to FIGS. 1 to 4, an outline of a sheet material container C1 (sheet material container filled with contents CA1) according to this embodiment will be described.

Figure 2:
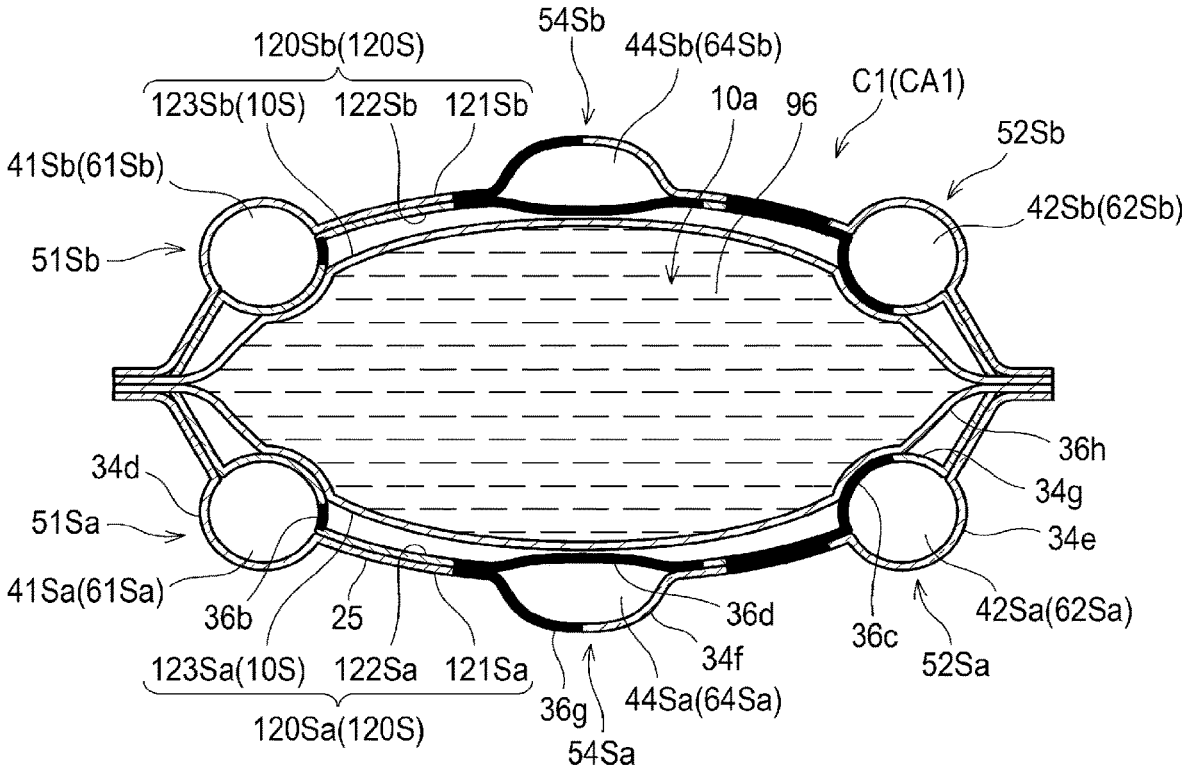
FIG. 2 is a sectional view of the sheet material container filled with contents taken along a line II-II in FIG. 1.
Figure 3A:
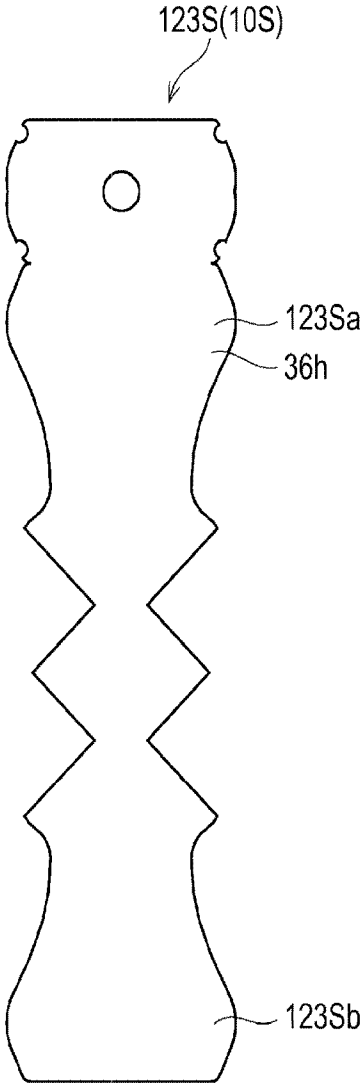
FIG. 3A is a plan view of an inner sheet constituting an inner bag of the sheet material container in an expanded state.
Figure 3B:
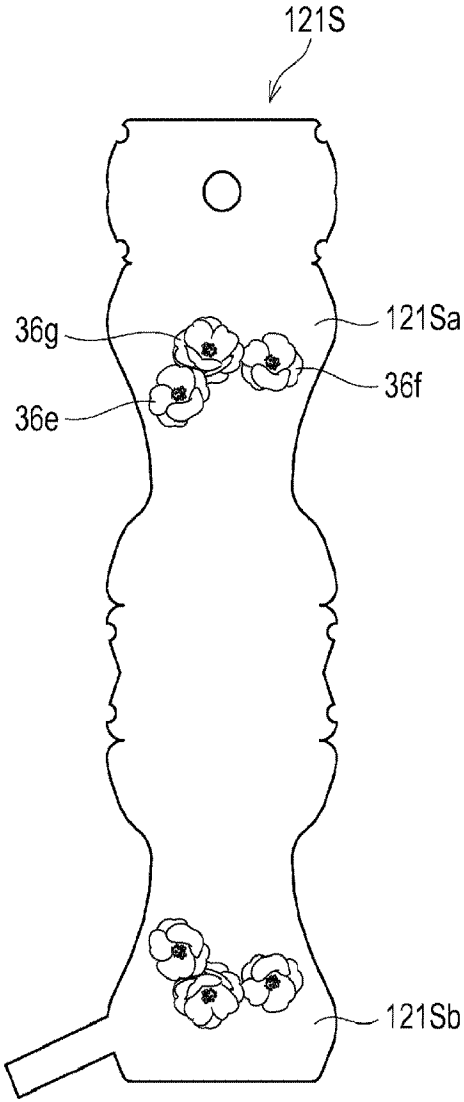
FIG. 3B is a plan view of an outer sheet in an expanded state (on the outer surface side)
Figure 3C:
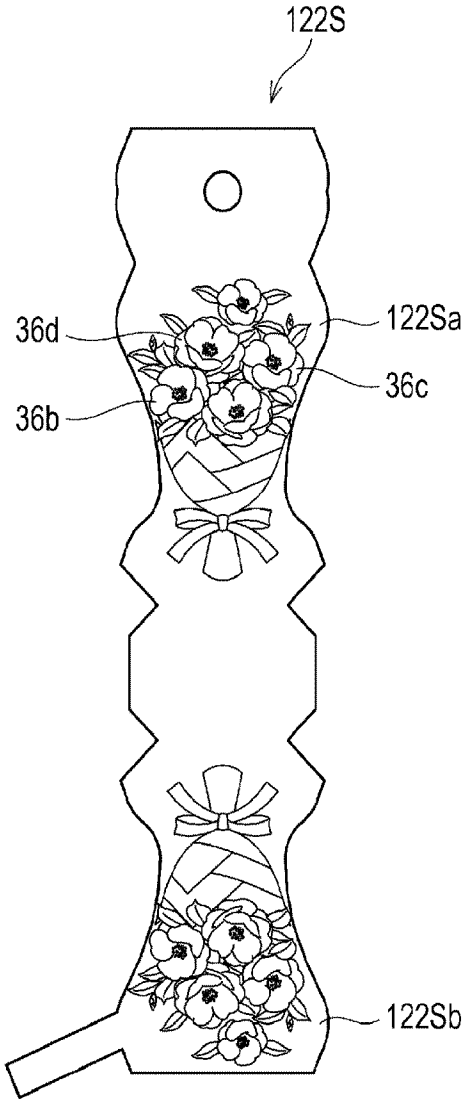
FIG. 3C is a plan view of an intermediate sheet 122S in an expanded state (on the outer surface side).
Figure 4:
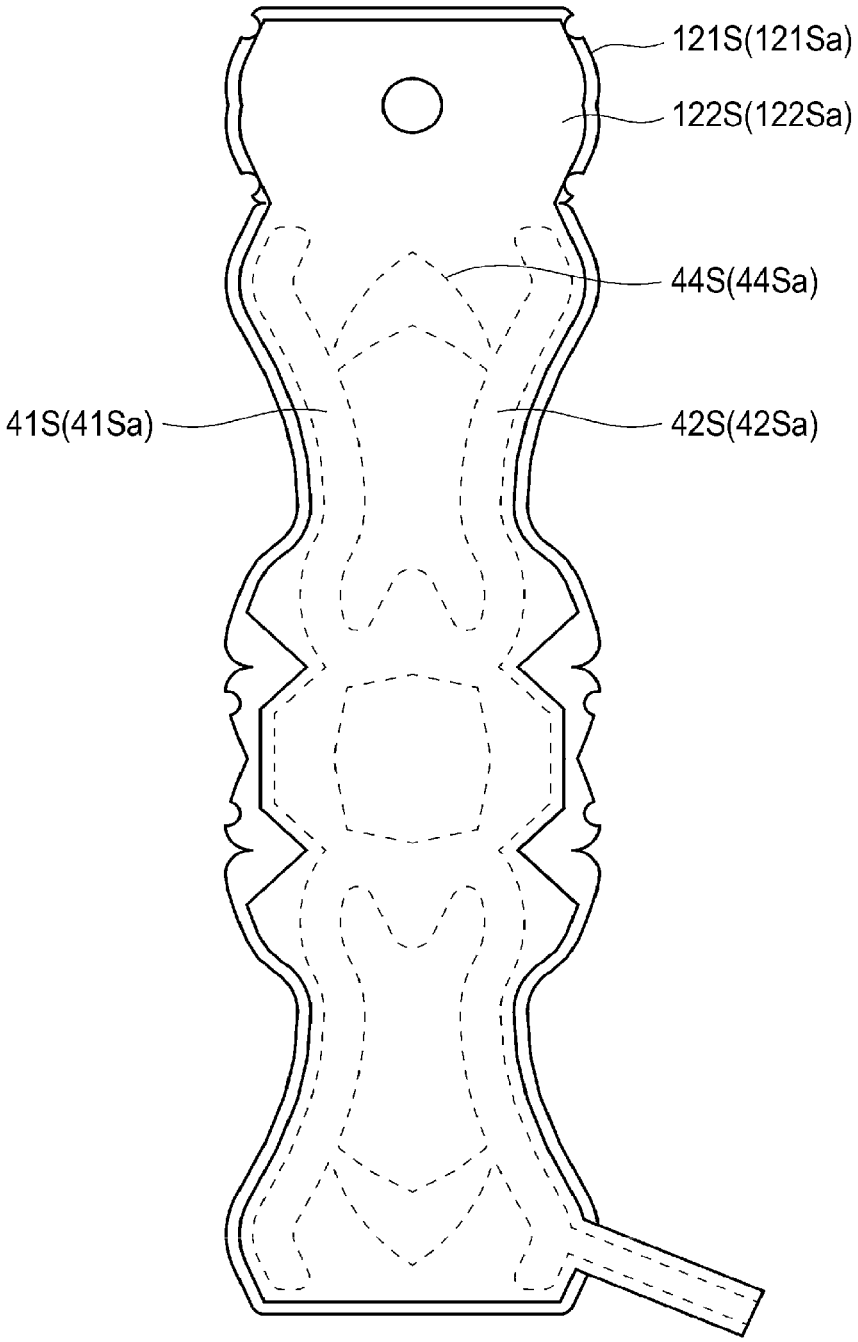
FIG. 4 is a plan view (inner side) of an expanded state of filled portions formed by attaching a part of the outer sheet and a part of the intermediate sheet.

FIG. 1 is a top perspective view showing a sheet material container C1 (sheet material container filled with contents CA1) according to the first embodiment. FIG. 2 is a sectional view of the sheet material container filled with contents CA1 taken along a line II-II in FIG. 1. FIG. 3A is a plan view of an inner sheet 123S constituting an inner bag 10S of the sheet material container C1 in an expanded state, FIG. 3B is a plan view of an outer sheet 121S in an expanded state (on the outer surface side), and FIG. 3C is a plan view of an intermediate sheet 122S in an expanded state (on the outer surface side). FIG. 4 is a plan view (inner side) of an expanded state of filled portions 41Sa, 42Sa, 44Sa, and the like formed by attaching a part of the outer sheet 121S and a part of the intermediate sheet 122S.

In FIG. 1, for convenience of explanation, the decorative portion is shown by distinguishing the line type. Specifically, the decorative portions 36*e*, 36*f*, 36*g* of the outer sheet 121S, which will be described later, are indicated by thick lines. In addition, in the decorative portion of the intermediate sheet 122S, the portion which is in close contact with the outer sheet 121S is indicated by a thin line, and the decorative portions 36*b*, 36*c*, 36*d* which are located inside the outer surface at the portion which forms the filled portions 41Sa, 42Sa, 44Sa are indicated by a broken line.

As shown in FIG. 1 to FIG. 4, the sheet material container C1 according to this embodiment is a sheet material container C1 including a containing portion 10*a* for storing the contents 96 and configured by a layer sheet 120S. The layer sheet 120S includes a first layer sheet 120Sa on one side (front side) of the sheet material container C1, and a second layer sheet 120Sb on the other side (rear side) of the sheet material container C1 with the containing portion 10*a* interposed therebetween.

The first layer sheet 120Sa includes a first inner layer sheet (first inner sheet 123Sa and/or first intermediate sheet 122Sa) and a first outer layer sheet (first outer sheet 121Sa) covering the outer side of the first inner layer sheet (first inner sheet 123Sa and/or first intermediate sheet 122Sa).

The second layer sheet 120Sb includes a second inner layer sheet (second inner sheet 123Sb and/or second intermediate sheet 122Sb) and a second outer layer sheet (second outer sheet 121Sb) covering the outer side of the second inner layer sheet (second inner sheet 123Sb and/or second intermediate sheet 122Sb).

At least one of the first inner layer sheet (the first inner sheet 123Sa and/or the first intermediate sheet 122Sa) and the first outer layer sheet (the first outer sheet 121Sa), or the second inner layer sheet (the second inner sheet 123Sb and/or the second intermediate sheet 122Sb) and the second outer layer sheet (the second outer sheet 121Sb) includes a attached portion 25 partially attached to each other and non-attached regions 61Sa, 61Sb, 62Sa, 62Sb, 64Sa, 64Sb that are not attached to each other.

Filled portions 41Sa, 41Sb, 42Sa, 42Sb, 44Sa, 44Sb enclosing a filler is formed between the first inner layer sheet (the first inner sheet 123Sa and/or the first intermediate sheet 122Sa) and the first outer layer sheet (the first outer sheet 121Sa) in the non-attached regions 61Sa, 62Sa, 64Sa, or between the second inner layer sheet (the second inner sheet 123Sb and/or the second intermediate sheet 122Sb) and the second outer layer sheet (the second outer sheet 121Sb) in the non-attached regions 61Sb, 62Sb, 64Sb.

Any two or more of the first inner layer sheet (the first inner sheet 123Sa and/or the first intermediate sheet 122Sa), the first outer layer sheet (the first outer sheet 121Sa), the second inner layer sheet (the second inner sheet 123Sb and/or the second intermediate sheet 122Sb) and the second outer layer sheet (the second outer sheet 121Sb) is a decorative sheet provided with decorative portions 36*b*, 36*c*, 36*d*, 36*e*, 36*f*, 36*g*, 36*h*.

The plurality of decorative sheets include overlapping portions 51Sa, 51Sb, 52Sa, 52Sb, 54Sa, 54Sb that overlap with each other while being separated from each other with the filled portions 41Sa, 41Sb, 42Sa, 42Sb, 44Sa, 44Sb interposed therebetween. Decorative portions 36*b*, 36*c*, 36*d*, 36*e*, 36*f*, 36*g*, 36*h* are provided in the overlapping portions 51Sa, 51Sb, 52Sa, 52Sb, 54Sa, 54Sb.

Among the first inner layer sheet (first inner sheet 123Sa and/or first intermediate sheet 122Sa), the first outer layer sheet (first outer sheet 121Sa) and the second inner layer sheet (second inner sheet 123Sb and/or second intermediate sheet 122Sb), a sheet on the one side of the sheet material container C1 with respect to the decorative portions 36*b*, 36*c*, 36*d*, 36*h* has light transmitting portions 34*d*, 34*e*, 34*f*, 34*g* capable of transmitting visible light.

The decorative portions 36*b*, 36*c*, 36*d*, 36*h* are configured to be at positions where visible light is transmitted from the outside of the sheet material container C1 by the light transmitting portions 34*d*, 34*e*, 34*f*, 34*g*.

As shown in FIG. 2, the sheet material container filled with contents CA1 includes a sheet material container C1 and contents 96 contained in the containing portion 10*a*.

The term "one side of the sheet material container C1 with the containing portion 10*a* interposed therebetween" or "the other side of the sheet material container C1 with the containing portion 10*a* interposed therebetween" means one side or the other side with at least apart of the containing portion 10*a* interposed therebetween, and for example, in the case where the containing portion has a pentagonal sectional shape, when an arbitrary one side is defined as one side, the other side includes either or both sides of two faces opposed to the one side.

The direction in which the containing portion 10*a* is sandwiched is arbitrary, and may be a vertical direction, a lateral width direction, or an oblique vertical direction in addition to the front and back directions in the sheet material container C1.

In addition, the inner sheet 123S, the intermediate sheet 122S, and the outer sheet 121S each may further include laminated layers.

At least a part of the first inner layer sheet (the first inner sheet 123Sa and/or the first intermediate sheet 122Sa) and at least a part of the second inner layer sheet (the second inner sheet 123Sb and/or the second intermediate sheet 122Sb) are attached to each other to form the containing portion 10*a*. The "containing portion" described above is only required to be capable of containing the contents 96, and in this embodiment, the inner bag 10S functions as the containing portion 10*a*, but the present invention is not limited to such a configuration.

That is, the inner bag 10S is constituted by the inner sheet 123S whose part is separable from the intermediate sheet 122S, but may be fixed to the intermediate sheet 122S. Further, with respect to the "containing portion", the sheet material container C1 may not be provided with the inner sheet 123S, and the intermediate sheet 122S may function as a containing portion for containing the contents 96.

The above-mentioned "covering the outside" may be any arrangement as long as it covers the outside, and includes an arrangement in which another sheet is disposed therebetween.

The "decorative portion" includes a portion in which a chromatic color is applied to the entire surface, a portion in which a chromatic color or an achromatic color is applied, and may or may not have a light transmittance. Furthermore, the "decorative portion" includes patterns, colors, characters, and symbols, and includes not only a portion formed by arbitrary printing of offset, gravure, flexography, and screen, but also a portion formed by pasting an already printed shrink film.

The "filled portion" is not limited to that formed in all the non-attached regions 61Sa, 62Sa, 61Sb, 62Sb, 64Sa, 64Sb, but may be formed in a part of a plurality of non-attached regions.

The "filler" may be a fluid (gas or liquid), a solid (for example, granules, resin pellets or the like) or a semisolid (for example, foamed material or the like), and is preferably a gas such as air.

The "light-transmitting portions 34*d*, 34*e*, 34*f*, 34*g*" are concepts including not only a material having a light transmittance but also a material which is transparent or translucent due to its small thickness.

"Light transmittance" herein refers to transmittance of light based on thicknesses or materials, and particularly refers to a function of transmitting visible light (400 nm to 700 nm). A portion that "can transmit visible light" may be a portion having higher visible light transmittance than other areas in the sheet material container C1. The visible light transmittance is preferably 5% or higher, more preferably 10% or higher, and preferably 100% or lower. The visible light transmittance can be measured with reference to JIS K7375: 2008.

The sheet material container C1 according to this embodiment is provided with the filled portions 41Sa, 41Sb, 42Sa, 42Sb, 44Sa, 44Sb between the outer sheet 121S and the intermediate sheet 122S, whereby the rigidity is increased and the shape can be stably maintained to a certain extent.

Specifically, for the general sheet material container formed of the layer sheet that is a soft packaging material, an outer container may be deformed as the sheet that forms an inner container is deformed. On the other hand, the sheet material container C1 according to this embodiment includes the filled portions 41Sa, 41Sb, 42Sa, 42Sb, 44Sa, 44Sb between the outer sheet 121S and the intermediate sheet 122S constituting the outer container, and thus has increased rigidity and can stably maintain its shape to some extent.

Further, since the light transmitting portions 34*d*, 34*e*, 34*f*, 34*g* capable of transmitting visible light are provided for the decorative portions 36*b*, 36*c*, 36*d*, 36*h* provided in the overlapping portions 51Sa, 51Sb, 52Sa, 52Sb, 54Sa, 54Sb, it is possible to impart a three-dimensional effect to the sheet material container C1 that cannot be expressed by normal film decoration in which only the outer surface of the sheet material container C1 is decorated.

First Embodiment

Next, referring mainly to FIGS. 1 to 4, a sheet material container C1 (sheet material container filled with contents CA1) according to the first embodiment of the present disclosure will be described in detail.

As shown in FIGS. 2 and 3 and described above, the sheet material container C1 is a container including the containing portion 10*a* for containing the contents 96, is composed of the layer sheet 120S, and has been subjected to three-dimensional flower bundle-like decoration.

The layer sheet 120S includes the inner sheet 123S, the intermediate sheet 122S covering an outer side of the inner sheet 123S, and an outer sheet 121S as an outer layer sheet covering an outer side of the intermediate sheet 122S.

In this embodiment, the layer sheet 120S is folded substantially at a middle part, and parts of peripheral edges thereof are attached to form the sheet material container C1.

The layer sheet 120S includes an inner sheet 123S, an intermediate sheet 122S covering the outer side of the inner sheet 123S, and the outer sheet 121S covering an outer side of the intermediate sheet 12.

The layer sheet 120S includes a first layer sheet 120Sa on the front side and a second layer sheet 120Sb on the back side.

Similarly, the inner sheet 123S constituting the layer sheet 120S includes a first inner sheet 123Sa on the front side and a second inner sheet 123Sb on the back side.

Similarly, the intermediate sheet 122S includes a first intermediate sheet 122Sa on the front side and a second intermediate sheet 122Sb on the back side.

Similarly, the outer sheet 121S includes a first outer sheet 121Sa on the front side and a second outer sheet 121Sb on the back side.

The first inner sheet 123Sa and the first intermediate sheet 122Sa covering the outer side of the first inner sheet 123Sa are also referred to as a first inner layer sheet.

The second inner sheet 123Sb and the second intermediate sheet 122Sb covering the outer side of the second inner sheet 123Sb are also referred to as a second inner layer sheet.

The first inner sheet 123Sa and the second inner sheet 123Sb are at least partially attached to each other to form the inner bag 10S.

A spout 30 for discharging the contents 96 in the containing portion 10*a* to the outside is disposed on the upper portion of the sheet material container C1.

The sheet material container C1 includes filled portions 41Sa, 41Sb, 42Sa, 42Sb, 44Sa, 44Sb which are expanded in the thickness direction of the sheet material container C1 by sealing the filler in the non-attached regions 61Sa, 61Sb, 62Sa, 62Sb, 64Sa, 64Sb between the outer sheet 121S and the intermediate sheet 122S.

Specifically, the filled portions 41Sa, 42Sa, 44Sa are formed in the non-attached regions 61Sa, 62Sa, 64Sa between the first outer layer sheet (first outer sheet 121Sa) and the first intermediate sheet 122Sa on the front side. The filled portions 41Sb, 42Sb, 44Sb are formed in the non-attached regions 61Sb, 62Sb, 64Sb between the second outer layer sheet (second outer sheet 121Sb) and the second intermediate sheet 122Sb on the back surface side.

In this manner, when the filled portions 41Sa, 42Sa, 44Sa, 41Sb, 42Sb, 44Sb are provided on both the front surface side and the back surface side of the sheet material container C1, the weight balance is easily obtained and the sheet material container C1 is easily brought into a self-supporting state, which is preferable. However, the filled portion according to the present invention is not limited to such a configuration, and may be provided only on one of the front side and the rear side in the case where the weight balance is maintained, or in the case where the filled portion does not need to be in a self-supporting state, or the like. Furthermore, the number of filled portions can be set arbitrarily.

The filled portions 41Sa, 42Sa and the filled portions 41Sb, 42Sb extend in the vertical direction along both edge portions in the width direction of the intermediate sheet 122S on both sides of the containing portion 10*a* on the front surface side and the back surface side of the sheet material container C1. The filled portions 44Sa and 44Sb are formed in an inverted V shape extending downward from the center portion in the width direction toward both edge portions in the width direction, and are connected to the filled portions 41Sa and 42Sa and the filled portions 41Sb and 42Sb on the front side and the back side.

It should be noted that the description of the vertical relationship in the present specification explains the positional relationship in a state in which the sheet material container C1 is self-supporting as shown in FIG. 1, unless otherwise specified. That is, the bottom in the state where the sheet material container C1 is placed on the horizontal placing surface is the lower side, and the opposite side is the upper side.

As shown in FIGS. 1 and 2, in the sheet material container C1, the light transmitting portion 34*d* and the decorative portion 36*e* are provided in the non-attached regions 61Sa and 61Sb forming the filled portions 41Sa and 41Sb in the outer sheet 121S.

In addition, the light transmitting portion 34*e* and the decorative portion 36*f* are provided in the non-attached regions 62Sa and 62Sb forming the filled portions 42Sa and 42Sb in the outer sheet 121S.

In addition, the light transmitting portion 34*f* and the decorative portion 36*g* are provided in the non-attached regions 64Sa and 64Sb forming the filled portions 44Sa and 44Sb in the outer sheet 121S.

Decorative portions 36*b*, 36*c*, 36*d* are provided on at least a part of the intermediate sheet 122S.

In this embodiment, the decorative portion 36*b* is provided at a part of a portion of the intermediate sheet 122S where the filled portions 41Sa and 41Sb are formed, the decorative portion 36*c* is provided at a part of a portion of the intermediate sheet 122S where the filled portions 42Sa and 42Sb are formed, and the decorative portion 36*d* is provided at a part of a portion of the intermediate sheet 122S where the filled portions 44Sa and 44Sb are formed.

A decorative portion 36*h* is provided on at least a part (the whole in this embodiment) of the inner sheet 123S (inner bag 10S).

In the sheet material container C1 according to this embodiment, the entire inner sheet 123S has a chromatic color. Specifically, the decorative portion 36*h* decorated with the chromatic color is formed on the entire inner sheet 123S.

The present invention is not limited to such a configuration, but the chromatic color may be applied to only an outer surface of the inner sheet 123S, or the chromatic color, an achromatic color, or patterns may be applied to only a part of the inner sheet 123S. The decorative portion may or may not have light transmittance.

In particular, the decorative portion 36*h* is provided at a position facing the filled portions 41Sa, 41Sb, 42Sa, 42Sb, 44Sa, 44Sb, 44Sb. The inner sheet 123S and the outer sheet 121S serving as the decorative sheet have overlapping portions that overlap with each other while being separated from each other with the filled portions 41Sa, 41Sb, 42Sa, 42Sb, 44Sa, 44Sb, 44Sb interposed therebetween. A decorative portion 36*h* is provided in the overlapping portion.

As shown in FIG. 2, the intermediate sheet 122S is provided with a light transmitting portion 34*g* that allows visible light to pass between the decorative portion 36*h* and the outside together with the light transmitting portion 34*e* of the outer sheet 121S.

In the sheet material container C1 according to this embodiment, the entire inner sheet 123S has a chromatic color. That is, the decorative portion 36*h* decorated by the chromatic color is formed on the entire inner sheet 123S. The decorative portion 36*h* is formed at a position overlapping with the light transmitting portions 34*e* and 34*g* when viewed from the outside of the sheet material container C1, and is at a position where visible light is transmitted from the outside of the sheet material container C1 by the light transmitting portions 34*e* and 34*g*.

There is no member (light-shielding member) including no light transmittance among the portion of the inner sheet 123S where the decorative portion 36*h* is provided, the portion of the intermediate sheet 122S where the light-transmitting portion 349 is provided, and the portion of the outer sheet 121S where the light-transmitting portion 34*e* is provided, and between the light-transmitting portion 34*g* and the light-transmitting portion 34*e*.

On the other hand, even a member that is not partially translucent may be provided between the inner sheet 123S and the intermediate sheet 122S or between the intermediate sheet 122S and the outer sheet 121S as long as it includes at least a part including translucency between the decorative portion 36*h* and the light transmitting portions 34*g* and 34*e*.

With this configuration, visible light can be transmitted to the decorative portion 36*h* of the inner sheet 123S via the light transmitting portion 34*e* of the outer sheet 121S and the light transmitting portion 34*g* of the inner sheet 123S.

The decorative portions 36*b*, 36*c*, 36*d*, 36*e*, 36*f*, 36*g* are disposed on the first inner layer sheet (the first inner sheet 123Sa and/or the first intermediate sheet 122Sa) and the first outer layer sheet (the first outer sheet 121Sa). The light transmitting portions 34*d*, 34*e*, 34*f* are provided on the first outer layer sheet (first outer sheet 121Sa). The user can directly visually recognize the decorative portions 36*e*, 36*f*, 36*g* provided on the first outer sheet 121Sa. Furthermore, the user can visually recognize the decorative portions 36*b*, 36*c*, 36*d* provided on the first intermediate sheet 122Sa via the light transmitting portions 34*d*, 34*e*, 34*f* provided on the first outer sheet 121Sa. The term "visibly recognizable" in this specification is not limited to clearly recognizable ones, and means that a person can recognize some existence.

As described above, since the decorative portions 36*b*, 36*c*, 36*d*, 36*e*, 36*f*, 36*g* are provided in the first inner layer sheet and the first outer layer sheet, it is possible to impart a three-dimensional effect, which cannot be expressed by normal film decoration, to the sheet material container C1.

In this embodiment, the decorative portions 36*b*, 36*c*, 36*d*, 36*e*, 36*f*, 36*g*, 36*h* are provided on the first outer layer sheet (first outer sheet 121Sa) and the first inner layer sheet (first inner sheet 123Sa or first intermediate sheet 122Sa) and/or the second outer layer sheet (second outer sheet 121Sb) and the second inner layer sheet (second inner sheet 123Sb or second intermediate sheet 122Sb) that face each other with the filled portions 41Sa, 42Sa, 44Sa (and filled portions 41Sb, 42Sb, 44Sb) interposed therebetween.

In this way, the decorative portion 36*b*, 36*c*, 36*d*, 36*e*, 36*f*, 36*g*, 36*h* is provided in the first inner layer sheet and the first outer layer sheet, and/or the second inner layer sheet and the second outer layer sheet, the user can visually recognize decorative portion 36*b*, 36*c*, 36*d*, 36*e*, 36*f*, 36*g*, 36*h* three-dimensionally from a plurality of directions (front side and back side in this embodiment), it is possible to enhance the design effect.

In this embodiment, the decorative portions 36*b*, 36*c*, 36*d* are formed at positions overlapping with the light transmitting portions 34*d*, 34*e*, 34*f* when viewed from the outside of the sheet material container C1. Specifically, at least a part of each of the light transmitting portions 34*d*, 34*e*, 34*f* is disposed at a position where visible light from the outside of the sheet material container C1 can be linearly transmitted with respect to the decorative portions 36*b*, 36*c*, 36*d*.

The decorative portion 36*h* is formed at a position overlapping any of the light transmitting portions 34*d*, 34*e*, 34*f* and the light transmitting portion 34*g* when viewed from the outside of the sheet material container C1. Specifically, at least a part of each of the light transmitting portions 34*d*, 34*e*, 34*f* and the light transmitting portion 34*g* is disposed at a position where visible light from the outside of the sheet material container C1 can be linearly transmitted with respect to the decorative portion 36*h*.

That is, the decorative portions 36*b*, 36*c*, 36*d*, 36*h* are located at positions where visible light is transmitted from the outside of the sheet material container C1 by at least one of the light transmitting portions 34*d*, 34*e*, 34*f*, 34*g*. In the outer sheet 121S and the intermediate sheet 122S according to this embodiment, almost the whole except for the decorative portions 36*b*, 36*c*, 36*d*, 36*e*, 36*f*, 36*g* is translucent.

In this embodiment, no member without light transmittance is provided between areas with the decorative portions 36*b*, 36*c*, 36*d* on the intermediate sheet 122S and areas with the light transmitting portions 34*d*, 34*e*, 34*f* in the outer sheet 121S.

Similarly, a member including no translucency is not provided among the portion where the decorative portion 36*h* is provided in the inner sheet 123S, the portion where the light-transmitting portion 34*g* is provided in the intermediate sheet 122S and the portions where the light-transmitting portions 34*d*, 34*e*, 34*f* are provided in the outer sheet 121S.

On the other hand, even a member that is not partially translucent may be provided between the intermediate sheet 122S and the outer sheet 121S as long as it includes at least a part including translucency between the decorative portions 36*b*, 36*c*, 36*d*, 36*h* and the light transmitting portions 34*d*, 34*e*, 34*f*, 34*g*.

Similarly, even a member that is not partially translucent may be provided between the inner sheet 123S and the intermediate sheet 122S, or between the intermediate sheet 122S and the outer sheet 121S as long as it includes at least a part including translucency among the decorative portion 36*h*, the light transmitting portions 34*d*, 34*e*, 34*f* and the light transmitting portion 34*g*.

With such a configuration, the visible light can be transmitted through the light transmitting portions 34*d*, 34*e*, 34*f* in the outer sheet 121S to the decorative portions 36*b*, 36*c*, 36*d* on the intermediate sheet 122S.

Similarly, visible light can be transmitted to the decorative portion 36*h* of the inner sheet 123S through the light transmitting portions 34*d*, 34*e*, 34*f* of the outer sheet 121S and the light transmitting portion 34*g* of the intermediate sheet 122S.

"Visible light is transmitted" herein refers to the visible light being transmitted as a physical phenomenon, and the visible light includes light that cannot be visually recognized by a human.

Further, according to the above configuration, gaps corresponding to an amount of the filler (such as air) are created between the outer sheet 121S forming outer surfaces of the filled portions 41Sa, 41Sb, 42Sa, 42Sb, 44Sa, 44Sb and the decorative portions 36*b*, 36*c*, 36*d*, 36*h*. Thus, together with the outer decorative portions 36*e*, 36*f*, 36*g* provided on the outer sheet 121S with light transmittance, the decorative portions 36*b*, 36*c*, 36*d* provided on the intermediate sheet 122S, and the decorative part 36*h* provided in the inner sheet 123S can provide a three-dimensional decorative expression.

The decorative portions 36*b*, 36*c*, 36*d*, 36*e*, 36*f*, 36*g*, 36*h* in the overlapping portions 51Sa, 52Sa, 54Sa (or the overlapping portions 51Sb, 52Sb, 54Sb) provided in the plurality of decorative sheets (for example, the first outer sheet 121Sa and the first intermediate sheet 122Sa) which overlap with each other while being separated from each other with the filled portions 41Sa, 41Sb, 42Sa, 42Sb, 44Sa, 44Sb interposed therebetween are decorative portions representing a group of represent objects.

Here, the "group of represent objects" refers to objects which are partially overlapped when the user views the sheet material container C1 from the outside, or objects which are related to each other even if they are not overlapped and are considered as an integral object.

This embodiment exemplifies a floral bundle pattern that collectively includes various flowers and grasses partially overlapped and represented as constituent elements. In addition, examples of objects related to each other and regarded as an integral object include a person and a shadow pattern of the person, or a pattern of the earth and a pattern of a person jumping out from the earth.

In this embodiment, the overlapping portion 51Sa indicates a portion where the filled portion 41Sa is provided, the overlapping portion 52Sa indicates a portion where the filled portion 42Sa is provided, and the overlapping portion 54Sa indicates a portion where the filled portion 44Sa is provided.

Similarly, the overlapping portion 51Sb indicates a portion where the filled portion 41Sb is provided, the overlapping portion 52Sb indicates a portion where the filled portion 42Sb is provided, and the overlapping portion 54Sb indicates a portion where the filled portion 44Sb is provided.

The decorative portions 36*b*, 36*c*, 36*d*, 36*e*, 36*f*, 36*g* in the overlapping portions 51Sa, 52Sa, 54Sa (or the overlapping portions 51Sb, 52Sb, 54Sb) provided in the plurality of decorative sheets (for example, the first outer sheet 121Sa and the first intermediate sheet 122Sa) respectively, are subjected to the same kind of decoration. The decorations 36*b*, 36*c*, 36*d*, 36*e*, 36*f*, 36*g* according to this embodiment are decorated with the same type of flowers, so that they can be viewed overlapped in the depth direction to create a depth feeling of the flower bunch.

The term "decoration of the same kind" means a decoration in which the classifications or kinds of objects represented are the same, such as plants of the same kind, animals (including humans) of the same kind, or products of the same classification.

Among the first inner layer sheet (first inner sheet 123Sa and/or first intermediate sheet 122Sa), the first outer layer sheet (first outer sheet 121Sa), the second inner layer sheet (second inner sheet 123Sb and/or second intermediate sheet 122Sb), and the second outer layer sheet (second outer sheet 121Sb), the decorative portions 36*e*, 36*f*, 36*g* provided on the sheet on the near side as viewed from the one side of the sheet material container C1 are shown to have a high sharpness as compared with the decorative portions 36*b*, 36*c*, 36*d*, 36*h* provided on the sheet on the rear side.

The "sharpness" includes the chromatic level and the degree of smoothness of the contour.

The "near side" means the proximal side of the user who looks at the sheet material container C1 from an arbitrary direction, and in this embodiment, is the front side. The "rear side" means the distal side of the user who looks at the sheet material container C1 from any direction, and in this embodiment, is the rear side.

In this manner, since the decorative portions 36*e*, 36*f*, 36*g* on the near side are shown with high sharpness compared with the rear side decorative portions 36*b*, 36*c*, 36*d*, 36*h*, the human can visually recognize the human vision so that the focus of the human vision is adjusted to the decorative portions 36*e*, 36*f*, 36*g* on the near side and does not match the rear side decorative portions 36*b*, 36*c*, 36*d*. Therefore, the sense of perspective can be emphasized more than the actual sense of depth can be generated more.

Further, the decorative portions 36*e*, 36*f*, 36*g* provided on the sheet on the near side may have a higher contrast than the decorative portions 36*b*, 36*c*, 36*d*, 36*h* provided on the sheet on the rear side.

"Contrast" refers to the difference in luminance between the darkest portion and the brightest portion.

In this manner, since the decorative portions 36*e*, 36*f*, 36*g* on the near side are shown with high contrast compared with the rear side decorative portions 36*b*, 36*c*, 36*d*, 36*h*, similarly to the above, it is possible to visually recognize the person so that the focus of the person's vision is adjusted to the near side decorative portions 36*e*, 36*f*, 36*g* and does not match the rear side decorative portions 36*b*, 36*c*, 36*d*. Therefore, the sense of perspective can be emphasized more than the actual sense of depth can be generated more.

In the outer sheet 121S and the intermediate sheet 122S according to this embodiment, substantially the whole other than the decorative portions 36*b*, 36*c*, 36*d*, 36*e*, 36*f*, 36*g* has been described as being translucent, but the present invention is not limited to such a configuration. For example, the decorative portions 36*b*, 36*c*, 36*d*, 36*e*, 36*f*, 36*g* may be transparent. That is, the light transmitting portion may be formed entirely on the intermediate sheet 122S and the outer sheet 121S.

In the outer sheet 121S according to this embodiment, the decorative portions 36*e*, 36*f*, 36*g* are provided in the non-attached regions 61Sa, 62Sa, 64Sa (and the non-attached regions 61Sb, 62Sb, 64Sb) forming the filled portions 41Sa, 42Sa, 44Sa (and the filled portions 41Sb, 42Sb, 44Sb).

Therefore, by filling the filled portions 41Sa, 41Sb, 42Sa, 42Sb, 44Sa, 44Sb with the filler and expanding in the thickness direction, a surface of the outer sheet 121S can be provided with an uneven shape. Thus, if the decorative portions 36*e*, 36*f*, 36*g* include areas with the uneven shape, thereby the decorative portions 36*e*, 36*f*, 36*g* can be expressed more three-dimensionally, and the decorative effect can be enhanced.

Further, the decorative portions 36*e*, 36*f*, 36*g* provided in the outer sheet 121S can be combined with the decorative portions 36*b*, 36*c*, 36*d* provided on the intermediate sheet 122S to provide three-dimensional decorative effects on different decorative surfaces.

The decorative portions 36*e*, 36*f*, 36*g* may be arranged offset with respect to the decorative portions 36*b*, 36*c*, 36*d* provided on the intermediate sheet 122S, or may be arranged in an overlapping manner as long as the decorative portions 36*e*, 36*f*, 36*g* have translucency. In addition, the decorative portions 36*e*, 36*f*, 36*g* may not have a light transmittance, and may completely overlap the decorative portions 36*b*, 36*c*, 36*d* in a certain direction. Even in this case, the decorative portions 36*b*, 36*c*, 36*d* provided on the intermediate sheet 122S may be visible from other directions from the light transmitting portions 34*d*, 34*e*, 34*f* provided on the outer sheet 121S, which are not the decorative portions 36*e*, 36*f*, 36*g*.

In particular, decorative expressions can be made at different depth positions in the sheet material container C1, thereby allowing wider variation of decoration. In particular, decorative expressions can be made at different depth positions in the sheet material container C1, thereby allowing wider variation of decoration. For example, a decorative portion 36*h* on the inner sheet 123S (for example, the first inner sheet 123Sa) may show an environment in water, the decorative portion on the intermediate sheet 122S (for example, the first intermediate sheet 122Sa) may show an environment on the ground, and the decorative portion on the outer sheet 121S (for example, the first outer sheet 121Sa) may show an environment in air.

As described above, since the decorative portions provided on the inner sheet 123S, the intermediate sheet 122S, and the outer sheet 121S provide different expressions according to a positional relationship among the inner sheet 123S, the intermediate sheet 122S, and the outer sheet 121S, it is possible to impart a decorative effect to the sheet material container C1 that is three-dimensional and has a sense of uniformity as a space.

Second Embodiment

Next, referring to FIGS. 5 to 8, a sheet material container C5 (sheet material container filled with contents CA5) according to the second embodiment of the present disclosure will be described.

Figure 5:
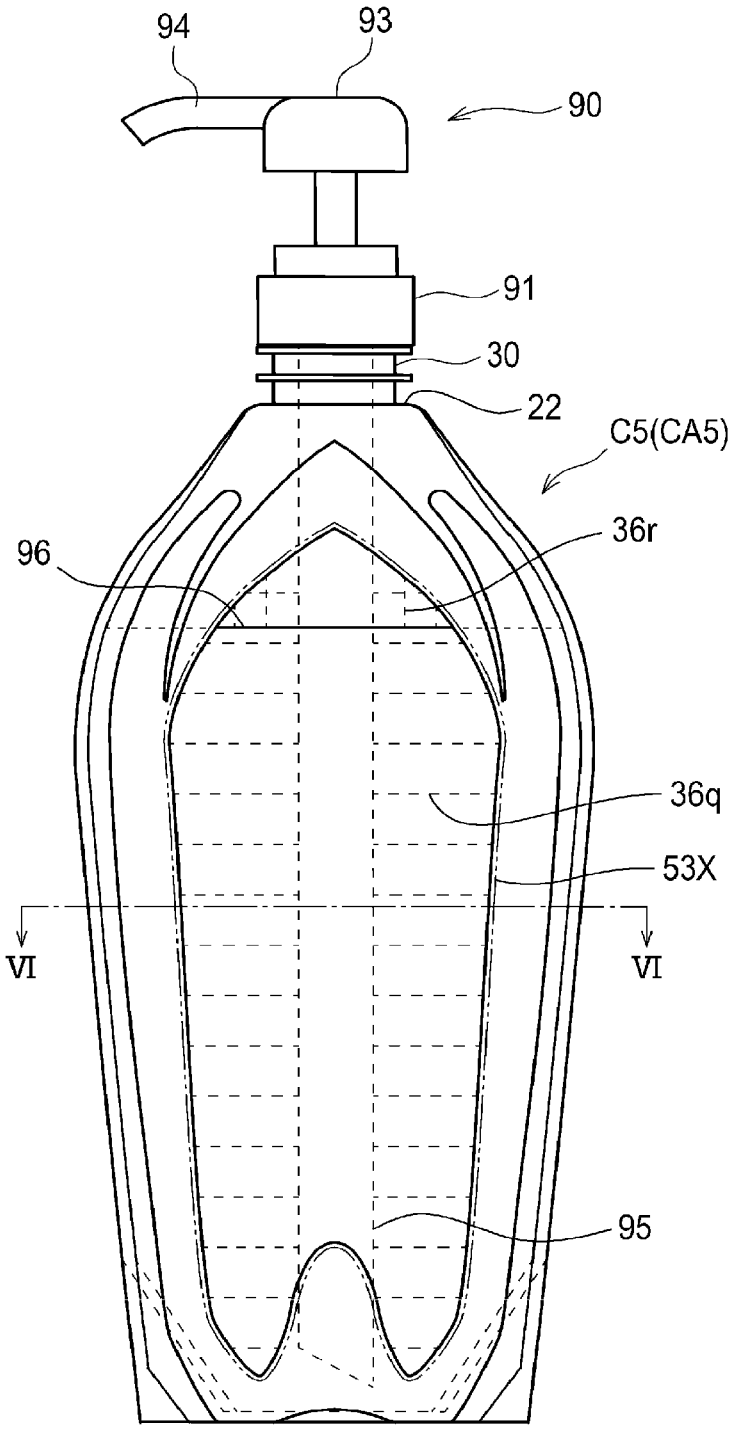
FIG. 5 is a front view of a sheet material container (sheet material container filled with contents) according to the second embodiment.
Figure 6:
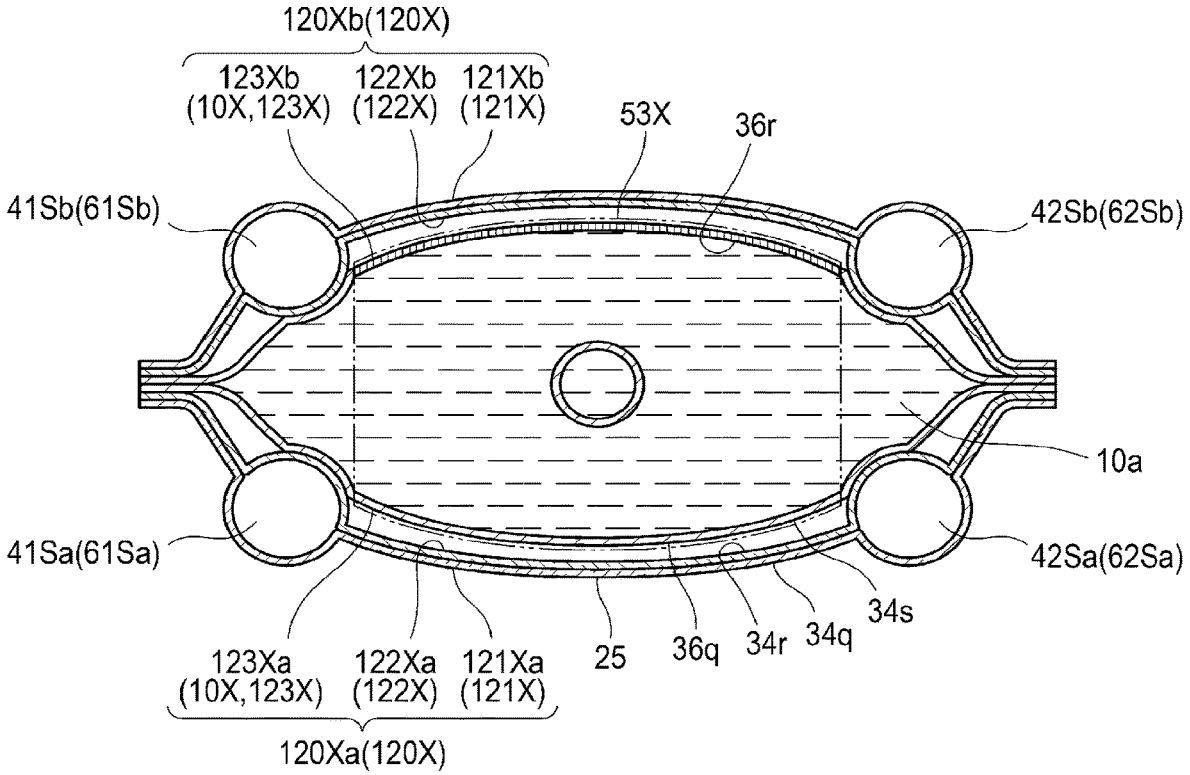
FIG. 6 is a sectional view of the sheet material container filled with contents taken along a line VI-VI in FIG. 5.
Figure 7:
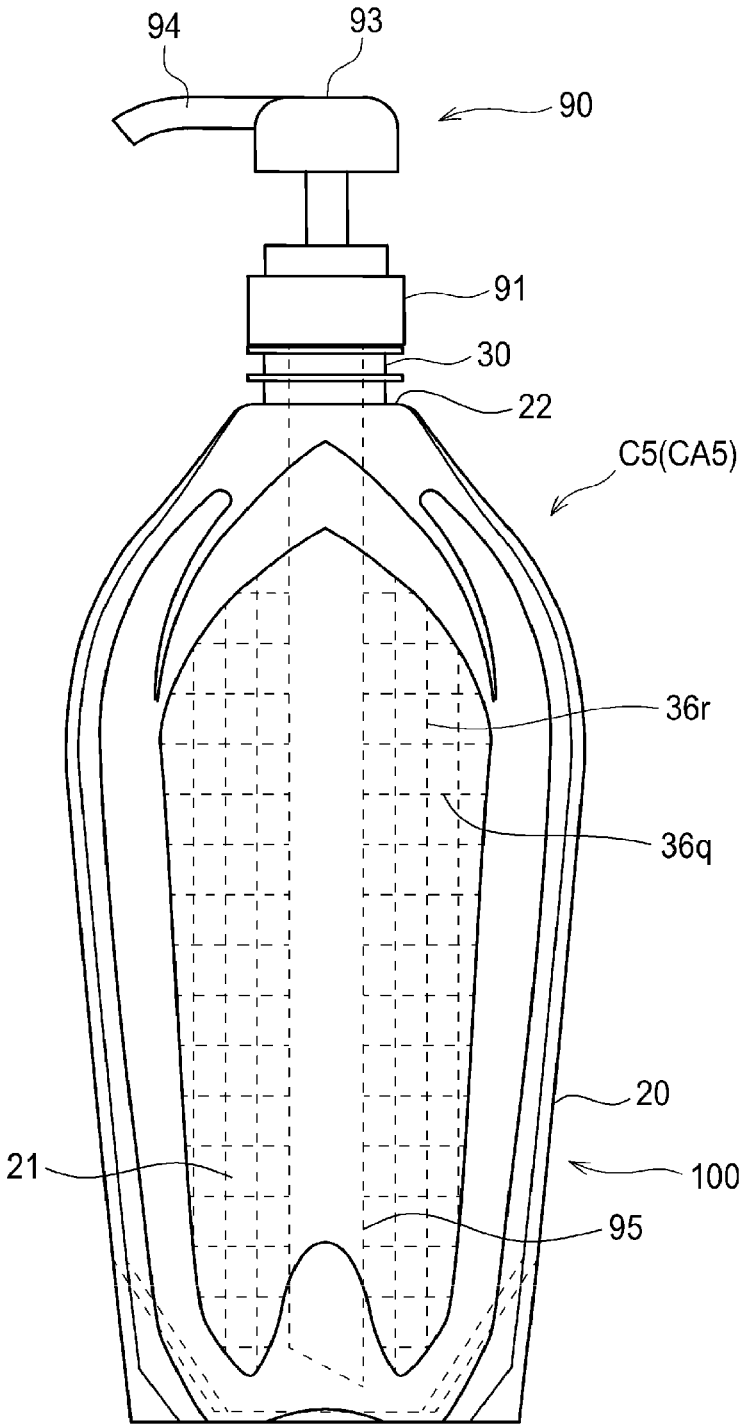
FIG. 7 is a front view of the sheet material container with a decorative portion being widely exposed.
Figure 8:
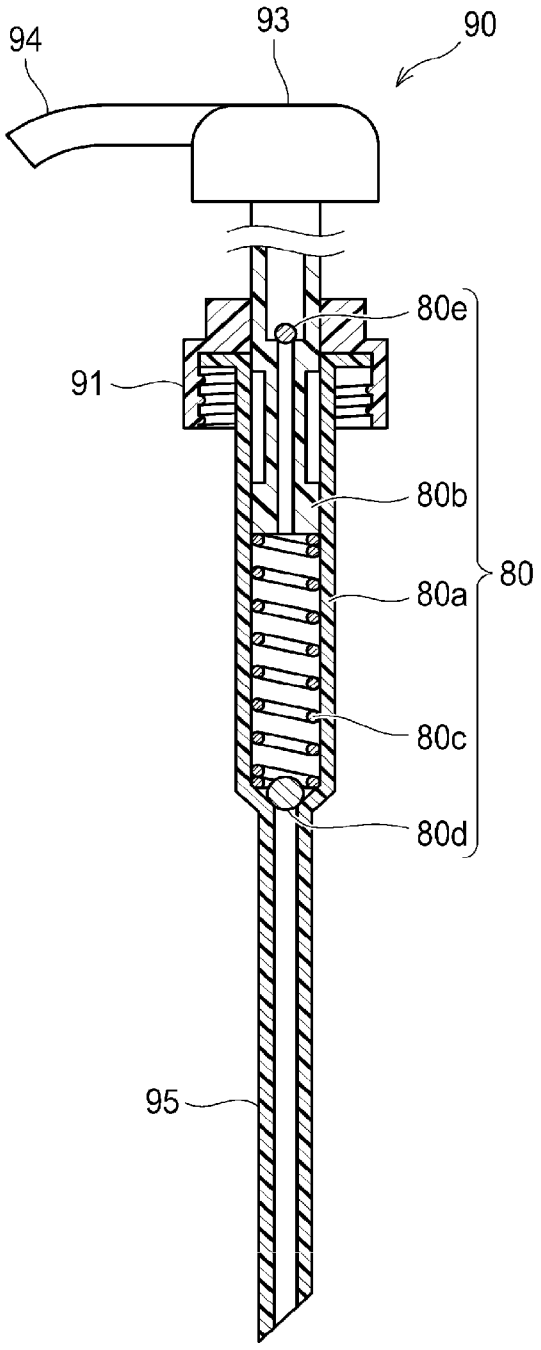
FIG. 8 is a schematic partial sectional view of a cap with pump including a check valve.

FIG. 5 is a front view of a sheet material container C5 (sheet material container filled with contents CA5) according to the second embodiment, FIG. 6 is a sectional view of a sheet material container filled with contents CA5 taken along a line VI-VI in FIG. 5. FIG. 7 is a front view showing the sheet material container C5 in a state in which the rear decorative portion 36*r* is widely exposed, and FIG. 8 is a schematic partial sectional view of the cap with pump 90 including the check valve.

The sheet material container C5 (sheet material container filled with contents CA5) is a container having a function of exposing the rear decoration portion 36*r* to the outside of the sheet material container C5 when the contents 96 in the containing portion 10*a* decreases, and representing a lattice-like pattern by being combined with the front decoration portion 36*q*.

As shown in FIG. 5 to FIG. 7, the sheet material container C5 according to this embodiment is a sheet material container C5 including the containing portion 10*a* for containing the contents 96 and configured by the layer sheet 120X. The layer sheet 120X includes a first layer sheet 120Xa on one side (front side) of the sheet container C5, and a second layer sheet 120Xb on the other side (back side) of the sheet container C5 with the containing portion 10*a* interposed therebetween.

The first layer sheet 120Xa includes a first inner layer sheet (first inner sheet 123Xa and/or first intermediate sheet 122Xa) and a first outer layer sheet (first outer sheet 121Xa) covering the outer side of the first inner layer sheet (first inner sheet 123Xa and/or first intermediate sheet 122Xa).

The second layer sheet 120Xb includes a second inner layer sheet (second inner sheet 123Xb and/or second intermediate sheet 122Xb) and a second outer layer sheet (second outer sheet 121Xb) covering the outer side of the second inner layer sheet (second inner sheet 123Xb and/or second intermediate sheet 122Xb).

Any plurality of the first inner layer sheet (the first inner sheet 123Xa and/or the first intermediate sheet 122Xa), the first outer layer sheet (the first outer sheet 121Xa), the second inner layer sheet (the second inner sheet 123Xb and/or the second intermediate sheet 122Xb) and the second outer layer sheet (the second outer sheet 121Xb) is a decorative sheet provided with the front decorative portion 36*q*, the rear decorative portion 36*r*.

In this embodiment, the first inner sheet 123Xa provided with the front decorative portion 36*q* and the second inner sheet 123Xb provided with the rear decorative portion 36*r* are decorative sheets.

The plurality of decorative sheets have overlapping portion 53X that overlap with each other while being separated from each other with the containing portion 10*a* interposed therebetween. A front decorative portion 36*q* and a rear decorative portion 36*r* are provided in the overlapping portion 53X.

Among the first inner layer sheet (the first inner sheet 123Xa and/or the first intermediate sheet 122Xa), the first outer layer sheet (the first outer sheet 121Xa) and the second inner layer sheet (the second inner sheet 123Xb and/or the second intermediate sheet 122Xb), the sheet on one side of the sheet material container C5 with respect to the front decorative portion 36*q* and the rear decorative portion 36*r* has light transmitting portions 34*q*, 34*r* and 34*s* capable of transmitting visible light.

The front decorative portion 36*q* and the rear decorative portion 36*r* are configured to be at positions where visible light is transmitted from the outside of the sheet material container C5 via the light transmitting portions 34*q*, 34*r*, 34*s*.

The front decorative portion 36*q* may be provided on at least one of the first outer layer sheet (first outer sheet 121Xa) and the first inner layer sheet (first inner sheet 123Xa and/or first intermediate sheet 122Xa).

The rear decorative portion 36*r* may be provided on at least one of the second outer layer sheet (second outer sheet 121Xb) and the second inner layer sheet (second inner sheet 123Xb and/or second intermediate sheet 122Xb).

The inner sheets 123X form the inner bag 10X by attaching at least a part of the periphery of the inner sheets 123X (the first inner sheet 123Xa and the second inner sheet 123Xb) to each other. For example, the contents 96 contained in the containing portion 10*a* does not have a light transmittance, or is configured in the same color or the same color range as the color of the rear decoration portion 36*r*. The containing portion 10*a* is formed by the inner bag 10X of the sheet material container C5. When the contents 96 having no translucency or the same color or the same color range as the color of the rear decoration portion 36*r* is contained in the containing portion 10*a*, the rear decoration portion 36*r* can be prevented from being exposed to the outside of the sheet material container filled with contents CA5 when viewed from the front of the sheet material container filled with contents CA5.

At least a part of the first inner sheet 123Xa is configured to be separable from the first intermediate sheet 122Xa, and at least a part of the second inner sheet 123Xb is configured to be separable from the second intermediate sheet 122Xb. Therefore, the volume of the inner bag 10X can be increased or decreased in accordance with the containing amount of the contents 96. The inner sheets 123X according to this embodiment is configured to be separable from the intermediate sheet 122X, except for a portion of the ceiling 22.

Since a part of the inner sheets 123X is configured to be separated from the intermediate sheet 122X in this manner, the contents 96 in the inner bag 10X can be easily discharged, and the residual contents 96 in the inner bag 10X can be suppressed. Further, the user can visually recognize the degree of swelling of the inner bag 10X from the outside of the sheet material container C5 through the light transmitting portions 34*q* and 34*r*. Therefore, the user can confirm the containing amount of the contents 96 from the degree of inflation of the inner bag 10X.

Further, as the inner volume of the inner bag 10X decreases, the inner sheet 123X is loosened such that wrinkles are generated in the inner sheet 123X, and a space is generated between the inner sheet 123X and the intermediate sheet 122X. For this reason, the inner bag 10X formed by the inner sheet 123X has a complicated three-dimensional shape and appears in the appearance of the sheet material container C5, so that a characteristic aesthetic appearance is imparted to the sheet material container C5.

The front decorative portion 36*q* and the rear decorative portion 36*r* in the overlapping portion 53X, which provided in the first inner sheet 123Xa and the second inner sheet 123Xb respectively separated from each other with the containing portion 10*a* interposed therebetween, are decorations representing a collective represent object.

Specifically, the front decorative portion 36*q* according to this embodiment is a horizontal stripe pattern, the rear decorative portion 36*r* is a vertical stripe pattern. They are a decoration representing a lattice-like pattern which is a group of represent objects by being partially overlapped from the outside of the sheet material container C5.

That is, when the contents 96 are discharged from the containing portion 10*a* to the outside of the sheet material container C5 by the cap with pump 90 and is reduced in the containing portion 10*a*, the decoration that was the horizontal striped pattern before the discharge appears as the decoration of the lattice-like pattern in which the front decoration portion 36*q* and the rear decoration portion 36*r* overlap.

The front decorative portion 36*q* is provided on at least one of the first outer layer sheet (first outer sheet 121Xa) and the first inner layer sheet (first inner sheet 123Xa or first intermediate sheet 122Xa). The rear decorative portion 36*r* is provided on at least one of the second outer layer sheet (second outer sheet 121Xb) and the second inner layer sheet (second inner sheet 123Xb or second intermediate sheet 122Xb).

Further, at least a part of the front decorative portion 36*q* and the rear decorative portion 36*r* is located at a position deviated as viewed from the on side (front side).

The front decorative portion 36*q* and the rear decorative portion 36*r* disposed on the first inner layer sheet (the first inner sheet 123Xa or the first intermediate sheet 122Xa) are configured to be able to transmit light to the outside of the sheet material container C5 on the one side by the light transmitting portion.

In this embodiment, the front decorative portion 36*q* is provided at a position between the filled portion 41Sa and the filled portion 42Sa in the lateral width direction in the first inner sheet 123Xa. The front decorative portion 36*q* is configured to be able to transmit light to the outside of the sheet material container C5 on the one side, i.e., the front side, by the light transmitting portions 34*q* and 34*r*. The rear decorative portion 36*r* is provided at a position between the filled portion 41Sb and the filled portion 42Sb in the lateral width direction in the second inner sheet 123Xb. The rear decorative portion 36*r* is configured to be able to transmit light to the outside of the sheet material container C5 on the one side, i.e., the front side, by the light transmitting portions 34*q*, 34*r*, 34*s*.

As described above, the front decorative portion 36*q* according to this embodiment is a horizontal stripe pattern, and the rear decorative portion 36*r* is a vertical stripe pattern. That is, the front decorative portion 36*q* and the rear decorative portion 36*r* are located at positions shifted from each other in the first inner sheet 123Xa and the second inner layer sheet.

As described above, the rear decoration portion 36*r* and the front decoration portion 36*q* are formed at least in a unidirectional deviated position out of the visible direction from the outer side of the sheet material container C5, so that the user can easily check the remaining amount of the contents 96 in the containing portion 10*a*.

In a typical delamination bottle (not shown) composed of a plastic container and a release film disposed inside the plastic container, the plastic container and the release film are molded from one parison. Since a closed space is formed by the release film and the inner surface of the plastic container, it is difficult to add decoration to the side of the release film facing the plastic container.

On the other hand, the sheet material container C5 according to this embodiment is configured to include the layer sheet 120X, and the layer sheet 120X can be formed by separately forming the inner sheet 123X, the intermediate sheet 122X, and the inner sheet 123X and partially attached them. Therefore, it is possible to provide the front decorative portion 36*q* and the rear decorative portion 36*r* on the inner sheet 123X in the stage before forming the layer sheet 120X.

Further, as shown in FIG. 5, the user cannot visually recognize the rear decorative portion 36*r* from the front side sandwiching the containing portion 10*a* with respect to the rear decorative portion 36*r* at the portion where the contents 96 and the rear decorative portion 36*r* overlap, and therefore, only the front decorative portion 36*q* having the horizontal stripe pattern can be visually recognized. On the other hand, when the contents 96 in the containing portion 10*a* decrease and the containing portion 10*a* (inner bag 10V) contracts in the depth direction, or when the contents 96 disappear in the containing portion 10*a* as shown in FIG. 7, the user can visually recognize the rear decorative portion 36*r* having the vertical stripe pattern. At this time, the user can visually recognize the decoration in which the front decorative portion 36*q* and the rear decorative portion 36*r* are combined, and can easily confirm the remaining amount of the contents 96 in the containing portion 10*a* by changing the pattern to a lattice-like pattern.

A check valve 80 shown in FIG. 8 is provided in the containing portion 10*a* of the sheet material container C5. The check valve 80 is provided in a direction to prevent air from flowing back into the containing portion 10*a* while allowing the contents 96 to be discharged from the containing portion 10*a*.

Here, the concept is that "a check valve 80 is provided in the containing portion 10*a*" is not limited to that provided directly in the containing portion 10*a*, but also includes that provided indirectly through the member. In this embodiment, a check valve 80 is provided in the containing portion 10*a* through a cap with pump 90. The cap with pump 90 enables the contents to be discharged from the containing portion 10*a* to the outside.

In this embodiment, as shown in FIG. 8, the check valve 80 is provided in the cap with pump 90 including a pressing portion 93 and a liquid feed tube 95. A cap portion 91 of the cap with pump 90 is mounted to a spout 30, and the cap with pump 90 is mounted to the inner bag 10X, and thus the check valve 80 is indirectly mounted to the inner bag 10X, and is provided in the containing portion 10*a*.

Specifically, the check valve 80 according to this embodiment includes a cylinder portion 80*a*, a piston portion 80*b* that can reciprocate in the cylinder portion 80*a*, a spring 80*c* that presses the piston portion 80*b* back to a protruding position, a spherical intake valve 80*d* provided in a lower part, and a spherical discharge valve 80*e* provided in an upper part.

If the user presses down the pressing portion 93, the piston portion 80*b* connected to the pressing portion 93 moves down against urging of the spring 80*c*. At this time, pressure in a space below the piston portion 80*b* increases to instantaneously raise the discharge valve 80*e* from the piston portion 80*b*.

If the user stops pressing the pressing portion 93, urging of the cylinder portion 80*a* spring 80*c* moves the piston portion 80*b* upward. At this time, the pressure in a space below the piston portion 80*b* decreases to instantaneously raise the intake valve 80*d*.

The intake valve 80*d* is raised to create a gap, through which the contents 96 are sucked through the liquid feed tube 95 into the cylinder portion 80*a* decreased in pressure. Then, the intake valve 80*d* moves down by its own weight, thereby preventing air from moving down into the inner bag 10X.

If the user further presses down the pressing portion 93 to increase the pressure in the space below the piston portion 80*b*, the discharge valve 80*e* is raised from the piston portion 80*b* to create a gap, through which the contents 96 are supplied to a nozzle portion 94, and the contents 96 are discharged from the nozzle portion 94.

With the check valve 80 being thus mounted to the inner bag 10X, an internal volume of the inner bag 10X increases or decreases according to an amount of the contents 96. In this case, unless the outer sheet 121X or the intermediate sheet 122X has light transmittance, it is difficult to check the amount of the contents 96 in the inner bag 10X.

On the other hand, in the sheet material container C5 according to this embodiment, the light transmitting portions 34*q*, 34*r*, 34*s* are provided on the front side of the sheet material container C5 in all of the inner sheet 123X, the intermediate sheet 122X, and the outer sheet 121X.

Specifically, the light transmitting portion 34*s* is provided on the first inner sheet 123Xa, the light transmitting portion 34*r* is provided on the first intermediate sheet 122Xa, and the light transmitting portion 34*q* is provided on the first outer sheet 121Xa, which are provided on the front side of the rear decorative portion 36*r* provided on the second inner sheet 123Xb.

More specifically, at least a part of the light transmitting portions 34*s*, 34*r*, 34*q* is arranged so as to be linearly overlapped with the rear decorative portion 36*r* at a position where visible light from the outside on the front side of the sheet material container C5 can be linearly transmitted.

Further, a member having no light transmittance is not provided between each of the first outer sheet 121Xa provided with the light-transmitting portion 34*q*, the first intermediate sheet 122Xa provided with the light-transmitting portion 34*r*, and the first inner sheet 123Xa provided with the light-transmitting portion 34*s*.

On the other hand, even a member that is not partially translucent may be provided between any of the first outer sheet 121Xa, the first intermediate sheet 122Xa, and the first inner sheet 123Xa as long as it is a member having translucency in at least a part linearly overlapping with the rear decorative portion 36*r* and the light transmitting portions 34*q*, 34*r*, 34*s*.

With this configuration, the user can confirm the above-described pattern that changes according to the internal volume of the contents 96 via the light transmitting portions 34*s*, 34*r*, 34*q*. It is also possible to check the inner volume of the contents 96 by checking the outer shape of the inner bag 10X.

The "check valve" according to the present invention is not limited to the check valve 80 with the above descried configuration as long as it can prevent air from flowing into the inner bag 10X. For example, a check valve such as a duckbill valve or of other structures which can be directly mounted to the inner bag 10X may be applied and provided in the spout 30.

In this embodiment, an example has been described in which the front decorative portion 36*q* is provided on the first inner sheet 123Xa and the rear decorative portion 36*r* is provided on the second inner sheet 123Xb, but the present invention is not limited to such a configuration as long as the decorative portions are provided on both sides sandwiching the containing portion 10*a*. For example, the first intermediate sheet 122Xa and/or the first outer sheet 121Xa on the front side may be provided with a front decorative portion, and the second intermediate sheet 122Xb and/or the second outer sheet 121Xb on the back side may be provided with a rear decorative portion. In this case, the sheet on the front side of the sheet material container with respect to the rear decorative portion may have a light transmitting portion capable of transmitting visible light.

Further, the decorative portion may be provided on both sides in an arbitrary direction sandwiching the containing portion 10*a* without being captured on the front side and the back side. At this time, it is sufficient if the user can visually recognize at least one of the decorative portions through the containing portion 10*a* when the contents 96 decrease.

The outer sheets 121S and 121X, the intermediate sheets 122S and 122X, and the inner sheets 123S and 123X that form the sheet material container according to the above described embodiments may be synthetic resin films, and for example, resin such as polyester resin, polyamide resin, or polypropylene resin may be used. However, the sheets are not limited to them as long as they form a container that contains contents.

The outer sheets 121S and 121X the intermediate sheets 122S and 122X, and the inner sheets 123S and 123X according to the above described embodiments may include further laminated layers. For example, the layers may be polyethylene terephthalate (PET) or stretched nylon (ONy) layers, transparent deposited PET layers formed of polyethylene terephthalate deposited with silica or alumina, stretched nylon layers, or linear low-density polyethylene (LLDPE), or combinations thereof.

The decorative portion provided on each sheet may be provided on a part of the laminated layers. The sheet material container may include other sheets in addition to the above described sheets.

The above described embodiment encompass the following technical ideas.

<1> A sheet material container comprising a containing portion that contains contents and formed of a layer sheet, wherein the layer sheet includes a first layer sheet on one side of the sheet material container, and a second layer sheet on the other side of the sheet material container with the containing portion interposed therebetween, the first layer sheet includes a first inner layer sheet and a first outer layer sheet covering the outer side of the first inner layer sheet, the second layer sheet includes a second inner layer sheet and a second outer layer sheet covering the outer side of the second inner layer sheet, at least one of the first inner layer sheet and the first outer layer sheet, or the second inner layer sheet and the second outer layer sheet has a attached portion partially attached to each other and a non-attached region not attached to each other, a filled portion enclosing a filler is formed between the first inner layer sheet and the first outer layer sheet in the non-attached region or between the second inner layer sheet and the second outer layer sheet in the non-attached region, any two or more of the first inner layer sheet, the first outer layer sheet, the second inner layer sheet and the second outer layer sheet are decorative sheets provided with a decorative portion, the plurality of decorative sheets have overlapping portions that overlap with each other while being separated from each other across the containing portion or the filled portion, and the decorative portion is provided in the overlapping portions, among the first inner layer sheet, the first outer layer sheet, and the second inner layer sheet, a sheet on the one side of the sheet material container with respect to the decorative portion has a light transmitting portion capable of transmitting visible light, the decorative portion is located at a position where visible light is transmitted from the outside of the sheet material container by the light transmitting portion.

<2> The sheet material container according to <1>, wherein the decorative portion is disposed on the first inner layer sheet and the first outer layer sheet, the light transmitting portion is provided on the first outer layer sheet.

<3> The sheet material container according to <1> or <2>, wherein the decorative portion in the overlapping portion provided in each of the plurality of decorative sheets is a decoration representing a group of represent objects.

<4> The sheet material container according to any one of <1> to <3>, wherein the decorative portion in the overlapping portion provided in each of the plurality of decorative sheets is subjected to the same kind of decoration.

<5> The sheet material container according to any one of <1> to <4>, wherein the decorative portion each of the first inner layer sheet, the first outer layer sheet, the second inner layer sheet, and the second outer layer sheet, which is provided on the sheet on the nearside when viewed from one side of the sheet material container, is shown in high sharpness as compared with the decorative portion provided on the sheet on the rear side.

<6> The sheet material container according to <5>, wherein the decorative portion provided on the sheet on the near side has a higher contrast as compared with the decorative portion provided on the sheet on the rear side.

<7> The sheet material container according to <1>, wherein the decorative part comprises a front decorative portion provided on at least one of the first outer layer sheet or the first inner layer sheet, and a rear decorative portion provided on at least one of the second outer layer sheet or the second inner layer sheet, at least a part of the front decorative portion and the rear decorative portion are located at positions shifted from each other when viewed from the one side, the rear decorative portion and the front decorative portion disposed on the first inner layer sheet are configured to be able to transmit light to the outside of the sheet material container on the one side by the light transmitting portion.

<8> The sheet material container according to <7>, wherein the decorative sheet provided with the front decorative portion and the decorative sheet provided with the rear decorative portion have the overlapping portions overlapping with each other while being separated from each other with the containing portion interposed therebetween, and the front decorative portion and the rear decorative portion are respectively provided in the overlapping portions.

<9> The sheet material container according to <8>, wherein a check valve is provided in the containing portion, the check valve is provided in a direction to prevent backflow of air into the containing portion while allowing the contents to be discharged from the containing portion.

<10> The sheet material container according to any one of <1> to <9>, wherein the decorative portion is provided on the first outer layer sheet and the first inner layer sheet, and/or the second outer layer sheet and the second inner layer sheet, which are opposed to each other with the filled portion interposed therebetween.

<11> The sheet material container according to any one of <1> to <10>, wherein the containing portion is formed by attaching at least a part of the first inner layer sheet and the second inner layer sheet to each other.

<12> The sheet material container according to any one of <1> to <11>, wherein the volume of the containing portion can be increased or decreased in accordance with the containing amount of the contents.

<13> The sheet material container according to any one of <1> to <10>, wherein the first inner layer sheet is composed of a first inner sheet and a first intermediate sheet covering the outer side of the first inner sheet, the second inner layer sheet is composed of a second inner sheet and a second intermediate sheet covering the outer side of the second inner sheet, the filled portion is formed in the non-attached region in which the first intermediate sheet and the first outer layer sheet or the second intermediate sheet and the second outer layer sheet are not attached to each other, the first inner sheet and the second inner sheet are at least partially attached to each other to form an inner bag.

<14> The sheet material container according to <13>, wherein the first inner sheet is separable from the first intermediate sheet, the second inner sheet is separable from the second intermediate sheet, and the volume of the inner bag is able to be increased or decreased according to the containing amount of the contents.

<15> The sheet material container according to <13> or <14>, wherein the decorative portion is provided on each of the first inner sheet, the first intermediate sheet, and the first outer layer sheet, the decorative portion provide different decorative expressions according to a positional relationship among the first inner sheet, the first intermediate sheet, and the first outer layer sheet.

<16> The sheet material container according to any one of <1> to <15>, wherein at least a part of the light transmitting portion is disposed at a position capable of linearly transmitting visible light from the outside of the sheet material container with respect to the decorative portion.

<17> The sheet material container according to any one of <1> to <16>, wherein the filled portion has an uneven shape, and the decorative portion includes an area with the uneven shape.

<18> The sheet material container according to any one of <1> to <17>, wherein the filled portion is provided on both sides of the sheet material container sandwiching the containing portion.

<19> The sheet material container according to any one of <1> to <18>, wherein the filled portion extends in the vertical direction.

<20> The sheet material container according to any one of <1> to <19>, wherein the filler is a gas.

<21> The sheet material container according to any one of <1> to <20>, wherein a spout for discharging the contents in the containing portion to the outside is disposed.

<22> The sheet material container according to <21>, wherein a cap portion of a cap with a pump is mounted to the spout.

<23> A sheet material container filled with contents, comprising:

the sheet material container according to any one of <1> to <22>; and the contents contained in the containing portion.

<24> The sheet material container filled with contents according to <23>, wherein the contents are the same color or the same color range as the color of the decorative portion.

REFERENCE SIGNS LIST 10a containing portion
10S, 10X inner bag
22 ceiling
25 attached portion
30 spout
34d, 34e, 34f, 34g, 34q, 34r, 34s, light transmitting portion
36b, 36c, 36d, 36e, 36f, 36g, 36h, 36q, 36r, decorative portion
41Sa, 41Sb, 42Sa, 42Sb, 44Sa, 44Sb, filled portion
51Sa, 51Sb, 52Sa, 52Sb, 53X, 54Sa, 54Sb, overlapping portion
61Sa, 61Sb, 62Sa, 62Sb, 64Sa, 64Sb, non-attached region
80 check valve
80a cylinder portion
80b piston portion
80c spring
80d intake valve
80e discharge valve
90 cap with pump
91 cap portion
93 pressing portion
94 nozzle portion
95 liquid feed tube
96 contents
120S, 120X layer sheet
120Sa, 120Xa first layer sheet
120Sb, 120Xb second layer sheet
121S, 121X outer sheet (decorative sheet, outer sheet)
121Sa, 121Xa first outer sheet (decorative sheet, first outer layer sheet)
121Sb, 121Xb second outer sheet (decorative sheet, second outer layer sheet)
122S, 122X intermediate sheet
122Sa, 122Xa first intermediate sheet (decorative sheet, first inner layer sheet)
122Sb, 122Xb second intermediate sheet (decorative sheet, second inner layer sheet)
123S, 123X inner sheet
123Sa, 123Xa first inner sheet (decorative sheet, first inner layer sheet)
123Sb, 123Xb second inner sheet (decorative sheet, second inner layer sheet)
C1 and C5 sheet material container
CA1 and CA5 sheet material container filled with contents

The invention claimed is:

1. A sheet material container comprising a layer sheet and having a containing portion configured to contain a content therein, wherein the layer sheet includes a first layer sheet on one side of the sheet material container, and a second layer sheet on the other side of the sheet material container such that the containing portion is interposed between the first layer sheet and the second layer sheet, the first layer sheet includes a first inner layer sheet and a first outer layer sheet covering the outer side of the first inner layer sheet, the second layer sheet includes a second inner layer sheet and a second outer layer sheet covering the outer side of the second inner layer sheet, at least one of the first inner layer sheet and the first outer layer sheet, or the second inner layer sheet and the second outer layer sheet has an attached portion partially attached to each other and a non-attached region not attached to each other, a filled portion enclosing a filler is formed between the first inner layer sheet and the first outer layer sheet in the non-attached region or between the second inner layer sheet and the second outer layer sheet in the non-attached region, any two or more of the first inner layer sheet, the first outer layer sheet, the second inner layer sheet and the second outer layer sheet are decorative sheets provided with a decorative portion, the plurality of decorative sheets have overlapping portions that overlap with each other while being separated from each other across the containing portion or the filled portion, and the decorative portion is provided in the overlapping portions, among the first inner layer sheet, the first outer layer sheet, and the second inner layer sheet, a sheet on the one side of the sheet material container with respect to the decorative portion has a light transmitting portion capable of transmitting visible light, and the decorative portion is located at a position where visible light is transmitted from the outside of the sheet material container by the light transmitting portion.

2. The sheet material container according to claim 1, wherein the decorative portion is disposed on the first inner layer sheet and the first outer layer sheet, and the light transmitting portion is provided on the first outer layer sheet.

3. The sheet material container according to claim 1, wherein the decorative portion in the overlapping portion provided in each of the plurality of decorative sheets is a decoration representing a group of represent objects.

4. The sheet material container according to claim 1, wherein the decorative portion of the first inner layer sheet, the first outer layer sheet, the second inner layer sheet, and the second outer layer sheet, which is provided on the sheet on the near side when viewed from one side of the sheet material container, is shown in high sharpness as compared with the decorative portion provided on the sheet on the rear side.

5. The sheet material container according to claim 4, wherein the decorative portion provided on the sheet on the near side has a higher contrast as compared with the decorative portion provided on the sheet on the rear side.

6. The sheet material container according to claim 1, wherein the decorative part comprises a front decorative portion provided on at least one of the first outer layer sheet and the first inner layer sheet, and a rear decorative portion provided on at least one of the second outer layer sheet and the second inner layer sheet, at least a part of the front decorative portion and the rear decorative portion are located at positions shifted from each other when viewed from the one side, and the rear decorative portion and the front decorative portion disposed on the first inner layer sheet are configured to be able to transmit light to the outside of the sheet material container on the one side by the light transmitting portion.

7. The sheet material container according to claim 6, wherein the decorative sheet provided with the front decorative portion and the decorative sheet provided with the rear decorative portion have the overlapping portions overlapping with each other while being separated from each other with the containing portion interposed therebetween, and the front decorative portion and the rear decorative portion are respectively provided in the overlapping portions.

8. The sheet material container according to claim 1, wherein the decorative portion is provided on the first outer layer sheet and the first inner layer sheet, and/or the second outer layer sheet and the second inner layer sheet, which are opposed to each other with the filled portion interposed therebetween.

9. The sheet material container according to claim 1, wherein the containing portion is formed by attaching at least a part of the first inner layer sheet and the second inner layer sheet to each other.

10. The sheet material container according to claim 1, wherein the volume of the containing portion increases or decreases in accordance with the containing amount of the content.

11. The sheet material container according to claim 1, wherein the first inner layer sheet is composed of a first inner sheet and a first intermediate sheet covering the outer side of the first inner sheet, the second inner layer sheet is composed of a second inner sheet and a second intermediate sheet covering the outer side of the second inner sheet, the filled portion is formed in the non-attached region in which the first intermediate sheet and the first outer layer sheet or the second intermediate sheet and the second outer layer sheet are not attached to each other, and the first inner sheet and the second inner sheet are at least partially attached to each other to form an inner bag.

12. The sheet material container according to claim 11, wherein the first inner sheet is separable from the first intermediate sheet, the second inner sheet is separable from the second intermediate sheet, and the volume of the inner bag increases or decreases according to the containing amount of the content.

13. The sheet material container according to claim 11, wherein the decorative portion is provided on each of the first inner sheet, the first intermediate sheet, and the first outer layer sheet, and the decorative portion provides different expressions according to a positional relationship among the first inner sheet, the first intermediate sheet, and the first outer layer sheet.

14. The sheet material container according to claim 1, wherein at least a part of the light transmitting portion is disposed at a position capable of linearly transmitting visible light from the outside of the sheet material container with respect to the decorative portion.

15. The sheet material container according to claim 1, wherein the filled portion has an uneven shape, and the decorative portion includes an area with the uneven shape.

16. The sheet material container according to claim 1, wherein the filled portion is provided on both sides of the sheet material container sandwiching the containing portion.

17. The sheet material container according to claim 1, wherein the filled portion extends in the vertical direction.

18. The sheet material container according to claim 1, wherein the filler is a gas.

19. A sheet material container filled with contents, comprising:

the sheet material container according to claim 1; and the contents contained in the containing portion.

* * * * *